US011617446B2

(12) United States Patent
Zhang

(10) Patent No.: US 11,617,446 B2
(45) Date of Patent: Apr. 4, 2023

(54) FOOTREST EXTENSION DEVICE, FRAME AND CHAIR HAVING THE SAME

(71) Applicant: Xiaozhao Zhang, Chuzhou (CN)

(72) Inventor: Xiaozhao Zhang, Chuzhou (CN)

( * ) Notice: Subject to any disclaimer, the term of this patent is extended or adjusted under 35 U.S.C. 154(b) by 62 days.

(21) Appl. No.: 17/333,014

(22) Filed: May 28, 2021

(65) Prior Publication Data

US 2022/0039558 A1 Feb. 10, 2022

(30) Foreign Application Priority Data

Aug. 7, 2020 (CN) ..... 202021638414.4

(51) Int. Cl.

| | |
|---|---|
| ***A47C 1/032*** | (2006.01) |
| ***A47C 1/034*** | (2006.01) |
| ***A47C 1/035*** | (2006.01) |
| ***A47C 1/0355*** | (2013.01) |
| ***A47C 7/50*** | (2006.01) |

(52) U.S. Cl.

CPC ..... *A47C 7/5068* (2018.08); *A47C 1/035* (2013.01); *A47C 1/0345* (2013.01); *A47C 1/03211* (2013.01); *A47C 7/5062* (2018.08)

(58) Field of Classification Search

CPC ..... A47C 7/5068; A47C 1/03211; A47C 1/0345; A47C 1/035; A47C 7/5062; A47C 1/0355

See application file for complete search history.

(56) References Cited

U.S. PATENT DOCUMENTS

| | | | | |
|---|---|---|---|---|
| 5,087,094 A * | 2/1992 | Rogers, Jr. | A47C 1/0355 297/69 |
| 5,110,179 A * | 5/1992 | Rogers | A47C 1/0355 297/75 |
| 5,374,100 A * | 12/1994 | Rogers | A47C 7/402 297/391 |
| 5,772,278 A * | 6/1998 | Kowalski | A47C 1/0355 297/85 L |
| 10,299,597 B1 * | 5/2019 | Crum | A47C 1/0355 |
| 11,452,378 B1 * | 9/2022 | Li | A47C 1/035 |

(Continued)

FOREIGN PATENT DOCUMENTS

CN 209547549 U 10/2019

OTHER PUBLICATIONS

CN2020216384144—First Office Action—dated Feb. 2, 2021.

*Primary Examiner* — Robert Canfield

(57) ABSTRACT

A footrest extension device for a chair includes eight connecting rods: a first connecting rod is connected to a main frame, and pivotally connected to a second connecting rod and a third connecting rod, respectively; the second connecting rod is connected to the main frame, and pivotally connected to a fourth connecting rod; the third connecting rod is pivotally connected to the fourth connecting rod, a sixth connecting rod and a eighth connecting rod, respectively; a fifth connecting rod is pivotally connected to the fourth connecting rod and the sixth connecting rod, respectively; the sixth connecting rod is pivotally connected to a seventh connecting rod; the seventh connecting rod is pivotally connected to the eighth connecting rod; and the second connecting rod, driven by a driving device, drives the other connecting rods to move, so the footrest extension device is folded or extended.

8 Claims, 7 Drawing Sheets

(56) References Cited

U.S. PATENT DOCUMENTS

2003/0015893 A1* 1/2003 Hoffman ..... G06F 17/142 297/85 R
2007/0257525 A1* 11/2007 Wiecek ..... A47C 1/0355 297/30
2010/0127555 A1* 5/2010 Hoffman ..... A47C 3/0255 297/344.21
2010/0127556 A1* 5/2010 Hoffman ..... A47C 1/0355 297/84
2011/0018331 A1* 1/2011 Murphy ..... A47C 1/0355 297/85 R
2012/0056462 A1* 3/2012 Wong ..... A47C 17/04 297/354.1
2012/0104827 A1* 5/2012 Murphy ..... A47C 1/037 297/85 M
2014/0132038 A1* 5/2014 Lu ..... A47C 1/035 297/68
2015/0173511 A1* 6/2015 Huang ..... A47C 1/0355 297/85 R
2015/0272335 A1* 10/2015 Lawson ..... A47C 7/506 297/423.19
2016/0058195 A1* 3/2016 Huang ..... A47C 1/031 248/398
2016/0073785 A1* 3/2016 Mackert ..... A47C 1/0345 297/423.19
2018/0027965 A1* 2/2018 Lawson ..... A47C 1/0345
2018/0103761 A1* 4/2018 White ..... A47C 1/0352
2018/0242740 A1* 8/2018 Lawson ..... A47C 1/024
2019/0038039 A1* 2/2019 Gu ..... A47C 1/0355
2019/0116978 A1* 4/2019 Jorbel ..... A47C 1/024
2019/0216221 A1* 7/2019 Bryant ..... A47C 1/0345
2019/0290004 A1* 9/2019 Lawson ..... A47C 1/0355
2019/0313796 A1* 10/2019 Lapointe ..... A47C 3/03
2019/0357681 A1* 11/2019 Fei ..... A47C 1/037
2020/0113333 A1* 4/2020 Crum ..... A47C 1/0355
2020/0163458 A1* 5/2020 Murphy ..... A47C 1/0355
2020/0275781 A1* 9/2020 Lawson ..... A47C 1/03211
2020/0305604 A1* 10/2020 Browning ..... A47C 1/03211
2020/0352334 A1* 11/2020 Browning ..... A47C 1/0355
2020/0367652 A1* 11/2020 Crawford ..... A47C 1/0355
2021/0100364 A1* 4/2021 Murphy ..... A47C 1/03211
2021/0196047 A1* 7/2021 Zhang ..... A61G 5/14
2021/0219727 A1* 7/2021 Zhang ..... A47C 3/20
2021/0361070 A1* 11/2021 Zhang ..... A47C 1/0355
2021/0386202 A1* 12/2021 Crum ..... A47C 1/0355
2022/0047080 A1* 2/2022 Li ..... A47C 1/0355
2022/0071396 A1* 3/2022 Zhang ..... A47C 7/5068
2022/0071397 A1* 3/2022 Zhang ..... A47C 1/0355
2022/0087423 A1* 3/2022 Zhang ..... A47C 1/0355
2022/0087431 A1* 3/2022 Zhang ..... A47C 7/5068
2022/0125200 A1* 4/2022 Zhang ..... A47C 1/032
2022/0218111 A1* 7/2022 Spontella ..... A47C 7/5068
2022/0312967 A1* 10/2022 Schuster ..... A47C 1/034

* cited by examiner

FOOTREST EXTENSION DEVICE, FRAME AND CHAIR HAVING THE SAME

CROSS-REFERENCE TO RELATED APPLICATIONS

This application claims all benefits accruing under 35 U.S.C. § 119 from China Patent Application No. 202021638414.4, filed on Aug. 7, 2020, titled "FOOTREST EXTENSION DEVICE, FRAME AND CHAIR HAVING THE SAME" in the China National Intellectual Property Administration, the content of which is hereby incorporated by reference.

TECHNICAL FIELD

The present disclosure generally relates to chairs, and in particular, to a footrest extension device, a frame and a chair having the same.

BACKGROUND

At present, a chair is provided with a footrest extension device. When a user is sitting or lying on the chair, the footrest extension device can be controlled to extend out from a seat portion of the chair to form a part of a footstool, so that the user can put feet on the footrest extension device when resting. The extended footrest extension device can also be controlled to fold and retract under the chair.

Such footrest extension device has poor stability during operation, because a structure of the footrest extension device is complex, there are many elements in the footrest extension device, and joints between the elements or motion pair elements are not closely matched. The footrest extension device cannot move accurately according to a preset trajectory, resulting in a large deviation between a motion trajectory formed during actual operation of the footrest extension device and an ideal preset trajectory. Therefore, an overall structure of the foot extension device is loose, and a wear degree of the joints between the elements will aggravate after long-term use, which is prone to failure and cannot meet requirements of the user well.

SUMMARY

The present disclosure provides a footrest extension device including a first connecting rod, a second connecting rod, a third connecting rod, a fourth connecting rod, a fifth connecting rod, a sixth connecting rod, a seventh connecting rod and an eighth connecting rod. The first connecting rod is connected to a main frame, and pivotally connected to the second connecting rod and the third connecting rod, respectively. The second connecting rod is connected to the main frame, and pivotally connected to the fourth connecting rod. The third connecting rod is pivotally connected to the fourth connecting rod, the sixth connecting rod and the eighth connecting rod, respectively. The fifth connecting rod is pivotally connected to the fourth connecting rod and the sixth connecting rod, respectively. The sixth connecting rod is pivotally connected to the seventh connecting rod. The seventh connecting rod is pivotally connected to the eighth connecting rod. The second connecting rod, driven by a driving device, is able to drive the first connecting rod, the third connecting rod, the fourth connecting rod, the fifth connecting rod, the sixth connecting rod, the seventh connecting rod and the eighth connecting rod to move, resulting in the footrest extension device being folded or extended.

In an embodiment, the first connecting rod, the second connecting rod, the third connecting rod, the fourth connecting rod, the fifth connecting rod, the sixth connecting rod, the seventh connecting rod and the eighth connecting rod are directly or indirectly pivotally connected by a rotating pivot or a rivet.

In this way, the footrest extension device is easier to be mounted and elements or components required for pivotally connecting the connecting rods are easier to be obtained.

In an embodiment, the fourth connecting rod is provided with a first platform and the eighth connecting rod is provided with a second platform. When the footrest extension device is extended, the first platform is flush with the second platform in a horizontal direction. When the footrest extension device is folded, the first platform is flush with the second platform in a vertical direction.

In this way, when the footrest extension device is extended relative to the main frame, the first platform is at a position with the same height as the second platform substantially, which is convenient for the user to lie down completely and put feet flat at the same time. When the footrest extension device is folded relative to the main frame, the footrest extension device is fully close to the main frame.

In an embodiment, the fourth connecting rod is located on a side close to the main frame of the eighth connecting rod when the footrest extension device is extended.

In this way, an interference between the first platform and the second platform can be avoided during a change process of the footrest extension device from an extended state to a folded state, i.e., motion trajectories of the first platform and the second platform can be prevented from crossing or even overlapping.

In an embodiment, a first limiting block is disposed on a sidewall of the first connecting rod, and the second connecting rod abuts against the first limiting block when the footrest extension device is folded.

In this way, the first limiting block can prevent the footrest extension device from being excessively folded, preventing collision or even extrusion of multiple connecting rods, thereby avoiding excessive wear of the connecting rods and pivot points between the connecting rods.

The present disclosure further provides a frame including a main frame, a connecting rod component for transmission and any one of the above footrest extension device. The connecting rod component for transmission is pivotally connected to the footrest extension device, and connected to the driving device.

In an embodiment, the connecting rod component for transmission comprises a rocker arm, a transmission connecting rod and a control connecting rod. A first end of the rocker arm is capable of rotating relative to the main frame driven by the driving device, a second end opposite to the first end of the rocker arm is pivotally connected to the transmission connecting rod, the transmission connecting rod is pivotally connected to the control connecting rod, and two ends of the control connecting rod are pivotally connected to the main frame and the second connecting rod, respectively. The rocker arm is capable of driving the control connecting rod to move via the transmission connecting rod when driven by the driving device, and the control connecting rod is capable of driving the footrest extension device to fold or extend.

In this way, the rocker arm, the transmission connecting rod, the control connecting rod and the main frame can form a four-bar mechanism with a certain motion trajectory, and the four-bar mechanism has an advantage of fast response speed. The four-bar mechanism can drive the footrest extension device to move at the same time when driven by the driving device, i.e., the footrest extension device can respond to power output of the driving device more quickly via the connecting rod component for transmission, resulting in avoiding a lag between a movement of the driving device and a movement of the footrest extension device.

In an embodiment, the main frame, the first connecting rod, the second connecting rod and the control connecting rod form a first four-bar mechanism. The first connecting rod, the second connecting rod, the third connecting rod and the fourth connecting rod form a second four-bar mechanism. The third connecting rod, the fourth connecting rod, the fifth connecting rod and the sixth connecting rod form a third four-bar mechanism. The third connecting rod, the sixth connecting rod, the seventh connecting rod and the eighth connecting rod form a fourth four-bar mechanism. The main frame, the rocker arm, the transmission connecting rod and the control connecting rod form a fifth four-bar mechanism. The first four-bar mechanism, the second four-bar mechanism, the third four-bar mechanism and the fourth four-bar mechanism are sequentially far away from the main frame. The driving device can drive the first four-bar mechanism, the second four-bar mechanism, the third four-bar mechanism and the fourth four-bar mechanism to move synchronically by driving the fifth four-bar mechanism.

In this way, the four-bar mechanisms can form certain motion trajectories. The footrest extension device, the main frame and the connecting rod component for transmission together constitute five four-bar mechanisms connected in series. The driving device can control these five four-bar mechanisms to move only by driving one of these five four-bar mechanisms. Because elements in the four-bar mechanisms are pivotally connected, the motion trajectories of these five four-bar mechanisms are determined. In other words, the motion trajectories of the footrest extension device and the connecting rod component for transmission are kept certain and will not change when the footrest extension device and the connecting rod component for transmission are driven by the driving device multiple times, so as to ensure a consistency of multiple motions of a chair.

The present disclosure further provides a chair including a driving device and any one of the above frames.

In an embodiment, the driving device includes a driving component, a sliding component, a connecting rod for power output and a power output shaft. The connecting rod for power output is pivotally connected to the sliding component and the power output shaft, respectively. The power output shaft is fixedly connected to the first end of the rocker arm. The sliding component can move relative to the main frame when driven by the driving component, resulting in driving the connecting rod for power output to move and driving the power output shaft to rotate around an axis of the power output shaft.

The present disclosure provides the footrest extension device. Each element in the footrest extension device is directly or indirectly pivotally connected to form multiple four-bar mechanisms connected in series. A stable and reliable rotating pair is formed between the elements, which overcomes defects of joints between the elements or motion pair elements not being closely matched, and an overall structure of the existing footrest extension device being loose. At the same time, stability and response sensitivity of the footrest extension device are improved. Even a mechanism or an element far away from the driving device in the footrest extension device can change a motion state rapidly with the power output of the driving device. Long-term use will not significantly aggravate a wear degree of the joints between the elements, and fault is not easy to produce.

In the figures, 100 represents a footrest extension device; 10 represents a first connecting rod; 11 represents a first limiting block; 20 represents a second connecting rod; 30 represents a third connecting rod; 40 represents a fourth connecting rod; 50 represents a fifth connecting rod; 60 represents a sixth connecting rod; 70 represents a seventh connecting rod; 80 represents an eighth connecting rod; 101 represents a first four-bar mechanism; 102 represents a second four-bar mechanism; 103 represents a third four-bar mechanism; 104 represents a fourth four-bar mechanism; 105 represents a fifth four-bar mechanism; 200 represents a frame; 210 represents a main frame; 220 represents a rocker arm; 221 represents a matching hole; 230 represents a transmission connecting rod; 240 represents a control connecting rod; 300 represents a chair; 301 represents a fixing frame; 302 represents a connecting rod component for front adjusting; 303 represents a connecting rod component for rear adjusting; 304 represents a slideway; 310 represents a driving component; 320 represents a sliding component; 321 represents a first reaming support; 322 represents a second reaming support; 330 represents a connecting rod for power output; 340 represents a power output shaft.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the present disclosure.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "or/and" as used herein includes any and all combinations of one or more of the associated listed items.

At present, a chair is provided with a footrest extension device. When a user is sitting or lying on the chair, the footrest extension device can be controlled to extend out from a seat portion of the chair to form a part of a footstool, so that the user can put feet on the footrest extension device when resting. The extended footrest extension device can also be controlled to fold and retract under the chair.

The present disclosure provides a footrest extension device 100, a frame 200 and a chair 300 having the footrest extension device 100. The footrest extension device 100 is configured to realize the above functions.

Figure 1:
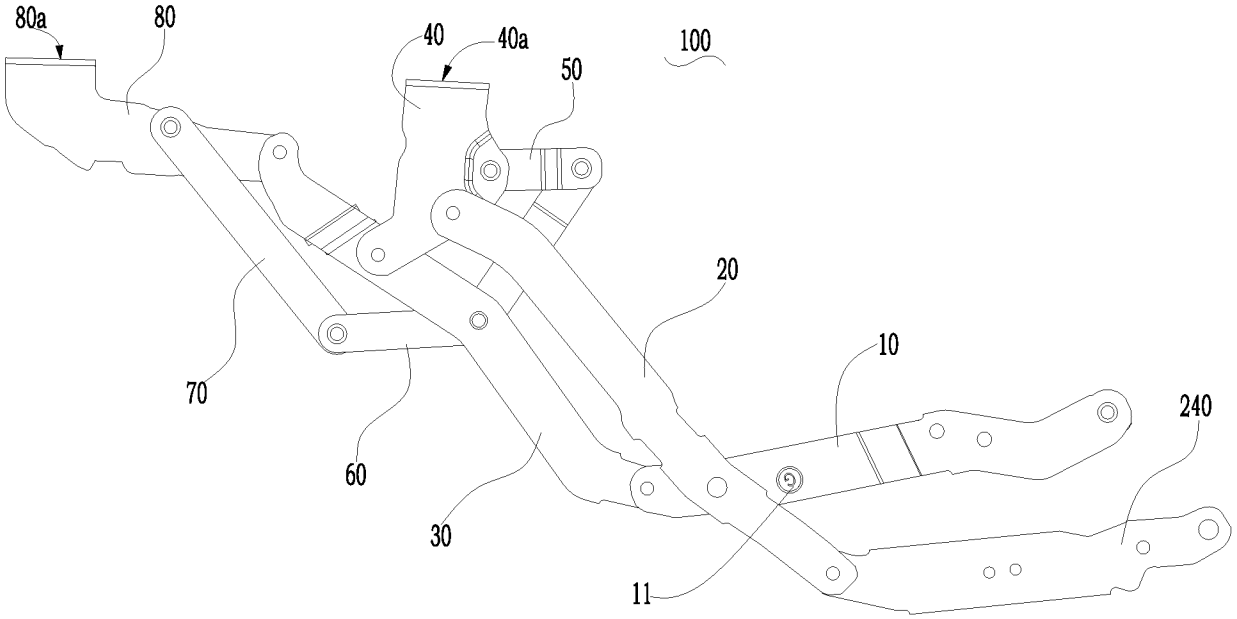
FIG. 1 is a structural schematic view of a footrest extension device in an extended state in an embodiment of the present disclosure.
Figure 2:
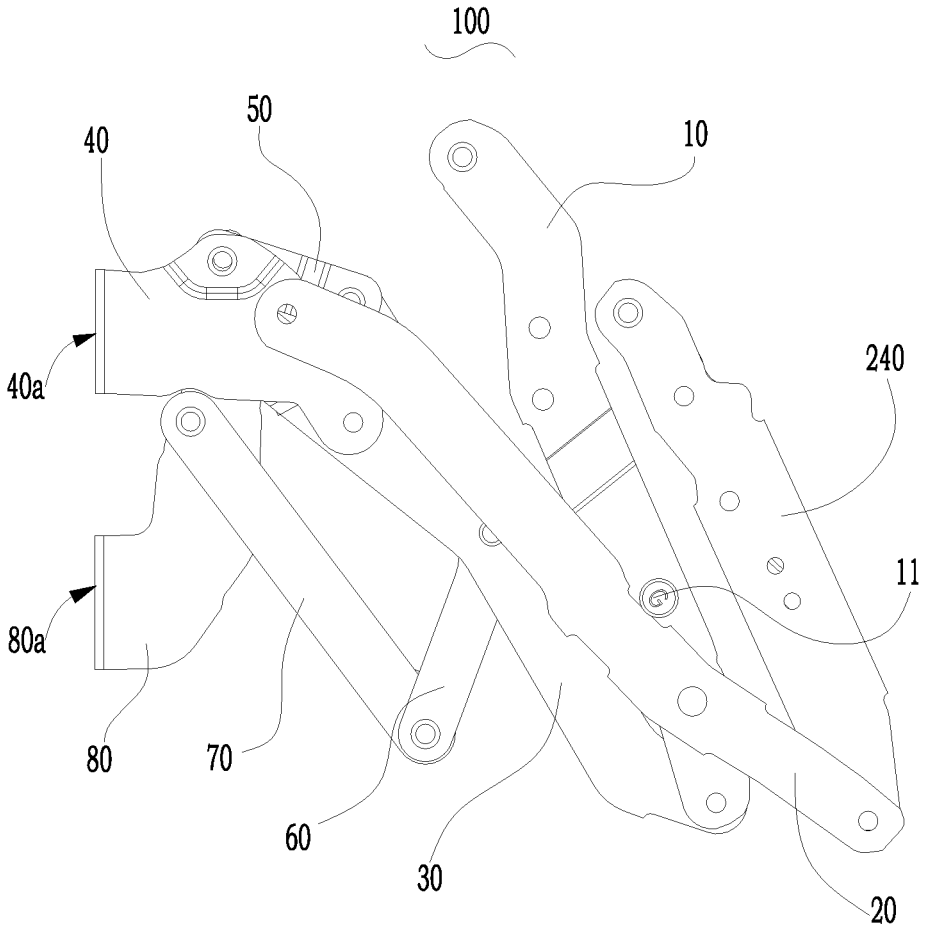
FIG. 2 is a structural schematic view of a footrest extension device in a folded state in another embodiment of the present disclosure.
Figure 3:
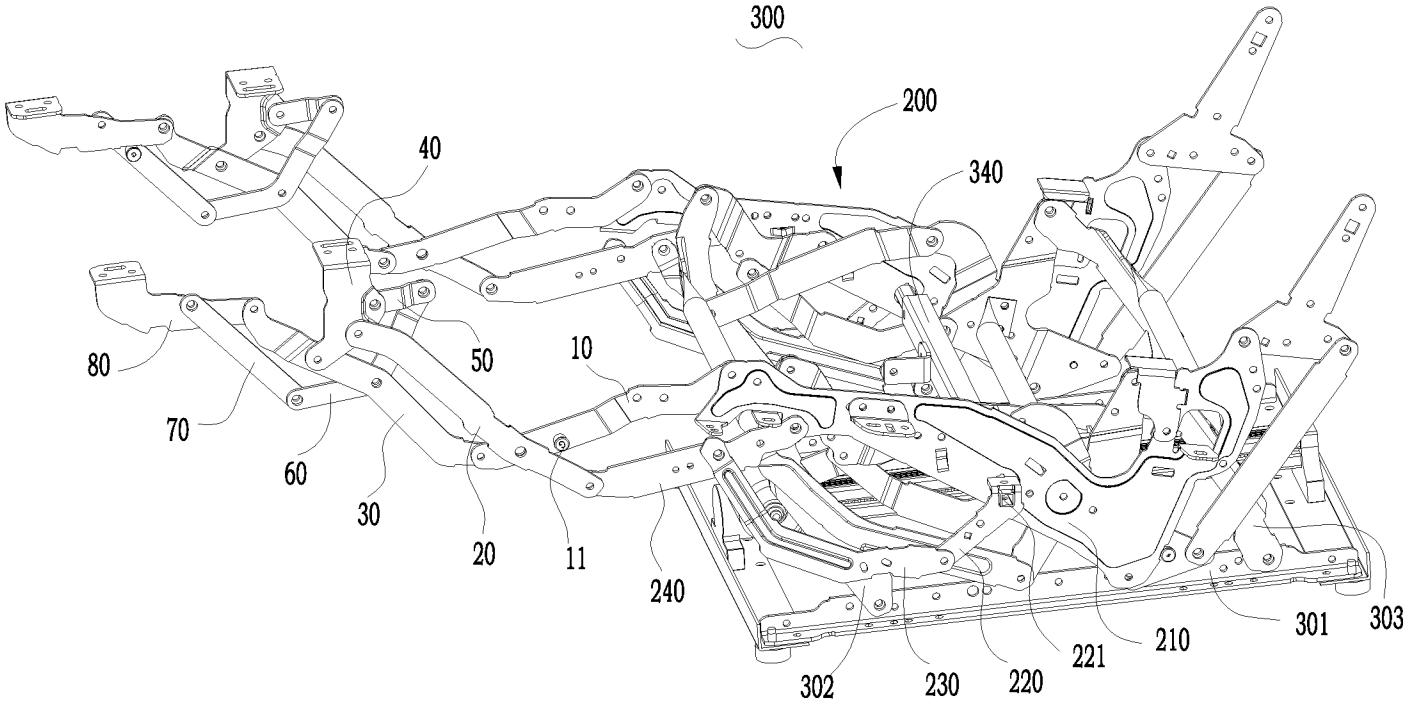
FIG. 3 is a structural schematic view of a chair in an embodiment of the present disclosure.
Figure 4:
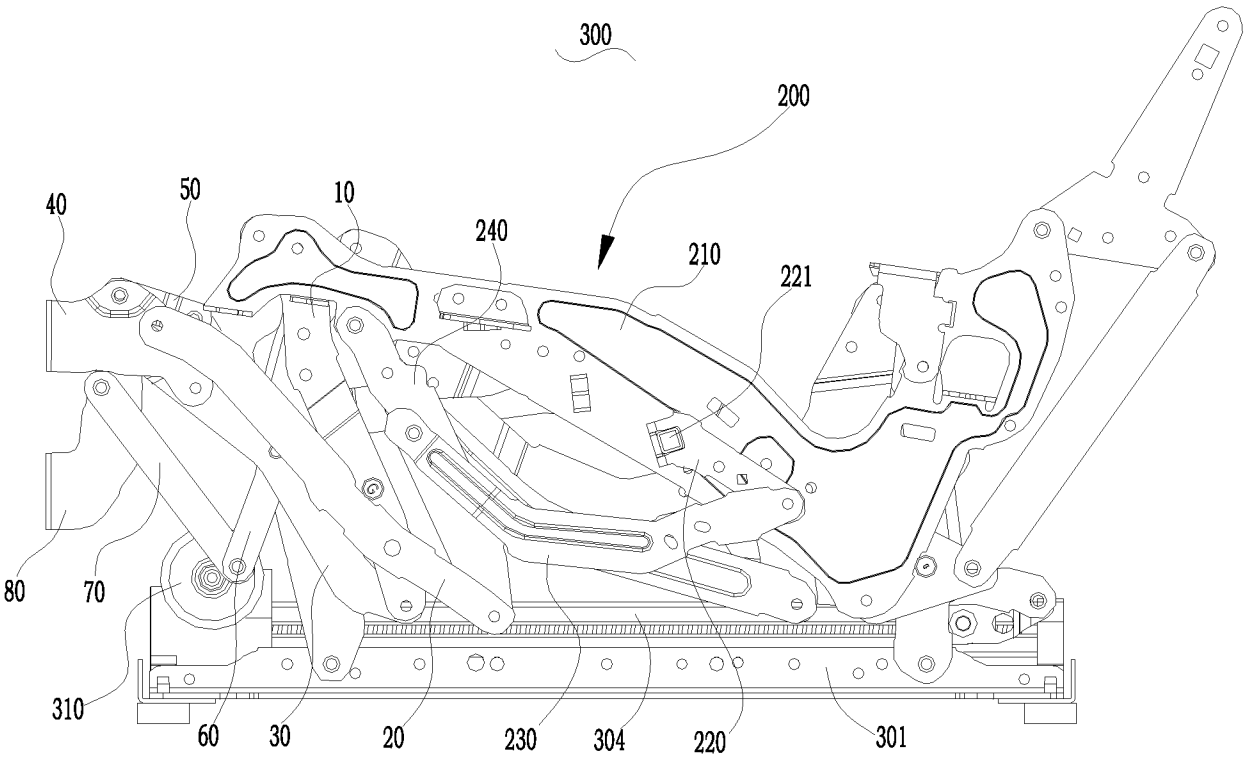
FIG. 4 is a structural schematic view of the chair of FIG. 3 with a footrest extension device in an extended state.
Figure 5:
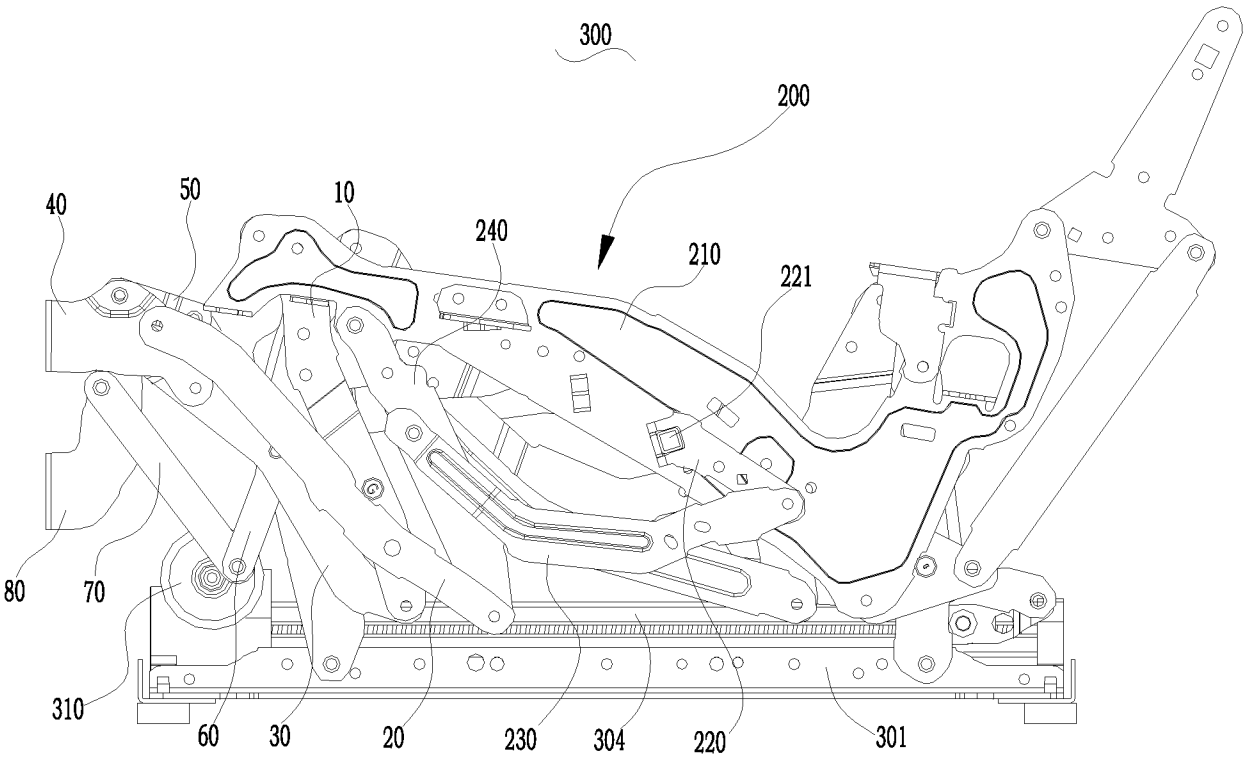
FIG. 5 is a structural schematic view of the chair of FIG. 3 with a footrest extension device in a folded state.
Figure 6:
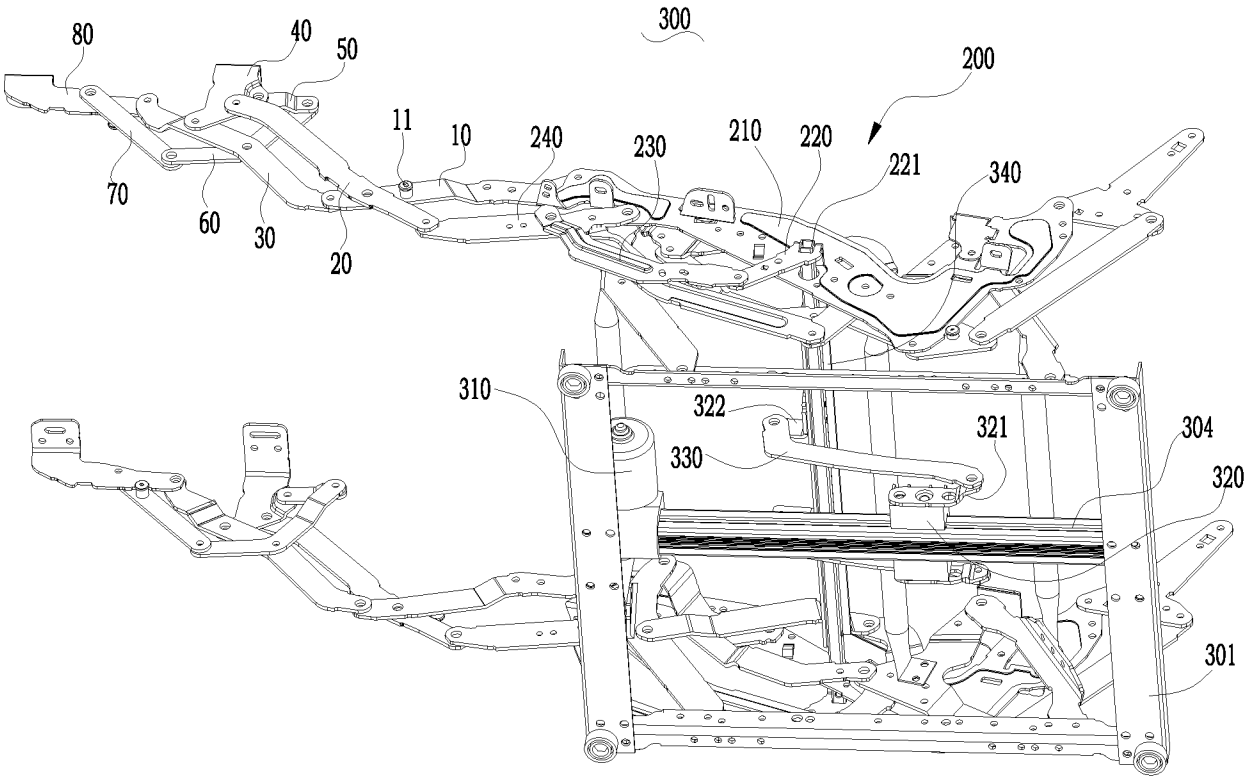
FIG. 6 is a schematic view of the chair of FIG. 3 in a first view.
Figure 7:
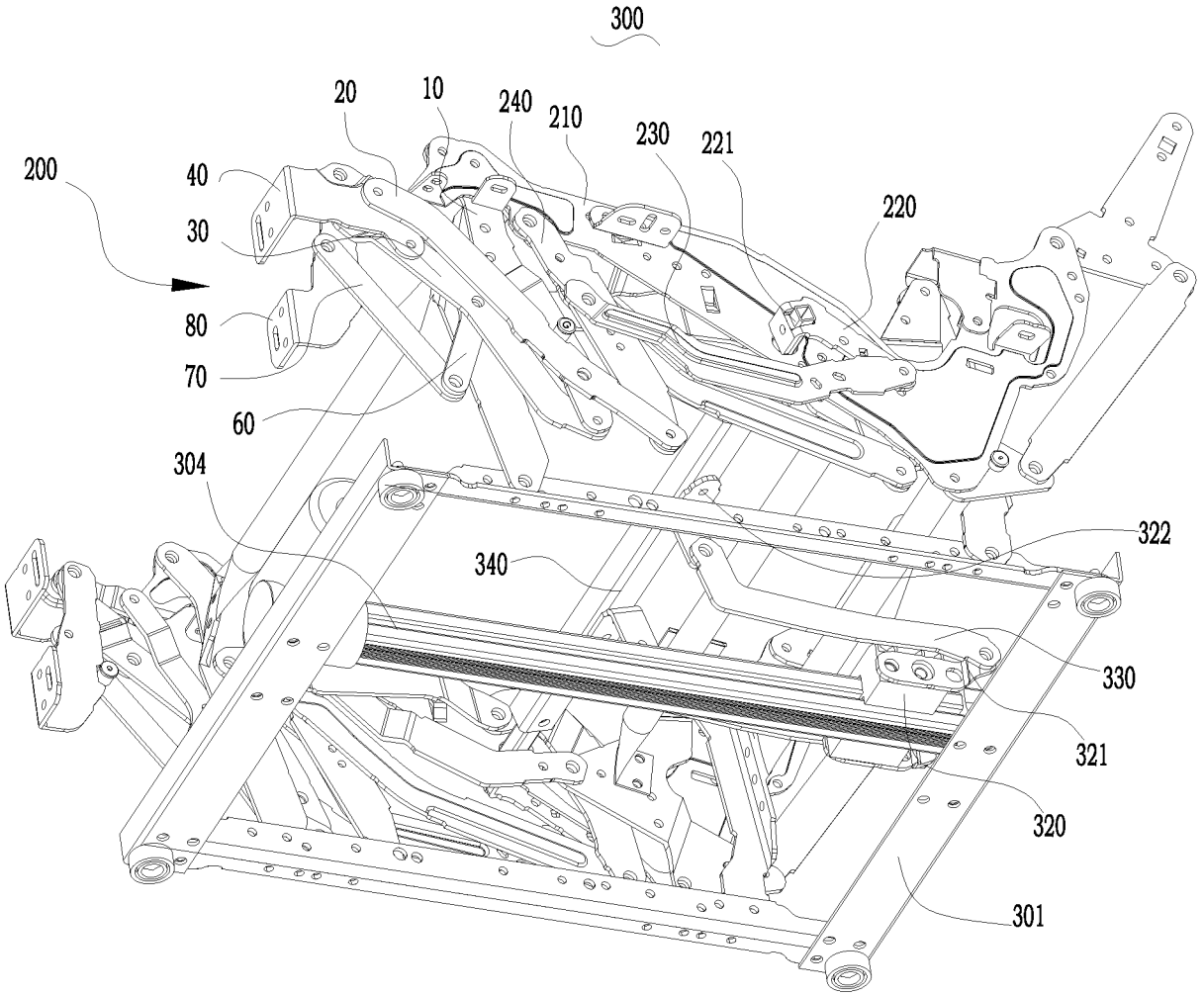
FIG. 7 is a schematic view of the chair of FIG. 3 in a second view.

FIG. 1 is a structural schematic view of a footrest extension device in an extended state in an embodiment of the present disclosure. FIG. 2 is a structural schematic view of the footrest extension device in a folded state in an embodiment of the present disclosure. FIG. 3 is a structural schematic view of a chair in an embodiment of the present disclosure. FIG. 4 is a structural schematic view of the chair of FIG. 1 with the footrest extension device in the extended state. FIG. 5 is a structural schematic view of the chair of FIG. 1 with the footrest extension device in the folded state. FIG. 6 is a schematic view of the chair of FIG. 3 in a first view. FIG. 7 is a schematic view of the chair of FIG. 3 in a second view.

The chair 300 can include a fixing frame 301 configured to support and mount various functional members or devices, a frame 200 configured to move relative to the fixing frame 301 for adjusting a sitting posture or a sitting position of the user, and a driving device configured to provide a power to adjust the sitting posture or the sitting position of the user.

Specially, the frame 200 can include a main frame 210 configured to support a weight of the user and move relative to the fixing frame 301, a footrest extension device 100 configured to support the feet of the user, and a connecting rod component for transmission connected to the driving device and configured to drive the footrest extension device 100 to move relative to the main frame 210 or the fixing frame 301. The main frame 210 can move or rotate relative to the fixing frame 301, so as to adjust the sitting position of the user, or the sitting posture of the user. The connecting rod component for transmission is pivotally connected to the footrest extension device 100, and configured to drive the footrest extension device 100 to extend or fold relative to the main frame 210 when driven by the driving device.

The main frame 210 is provided with a rest cushion, a front cushion, a seat back and other components for the user to rest (not shown in the figure). The main frame 210 can be pivotally connected to the fixing frame 301 by a connecting rod component for front adjusting 302 and a connecting rod component for rear adjusting 303. The movement of the connecting rod component for front adjusting 302 and the connecting rod component for rear adjusting 303 is driven by the driving device to change a position or an angle of the main frame 210 relative to the fixing frame 301, so as to adjust a sitting posture.

The structure of the main frame 210 and a connecting mode between the main frame 210 and the fixing frame 301 are not technical contents required to be protected by the present disclosure. Therefore, the structure, the connecting mode and a movement relationship between the main frame 210 and the fixing frame 301 are not expounded.

The footrest extension device 100 can include multiple connecting rods pivotally connected, which are pivotally connected to one end of the main frame 210 near the feet of the user, and capable of extending from a folded state as shown in FIG. 2 to an extended state as shown in FIG. 1 in a direction away from the main frame 210. The footrest extension device 100 can abut against the main frame 210 in the folded state to place the feet of the user when the user is in a semi-lying position, and the footrest extension device 100 can allow the user to lie down completely and support the feet of the user in the extended state.

It should be understood that the elements of the footrest extension device 100 discussed in the present disclosure may be made of any suitable material known in the furniture manufacturing industry, such as plate or rod shaped metal profiles (such as stamped steel). In addition, it should be recognized that the footrest extension device 100 and the frame 200 can be connected together by using any technique or mechanism known in the furniture manufacturing industry. For example, rigidly connected members can be connected by a rotating pivot, a rivet, a bolt, etc.

The connecting rod component for transmission is configured to transfer a power output from the driving device to the footrest extension device 100. In an embodiment of the present disclosure, the connecting rod component for transmission includes a rocker arm 220, a transmission connecting rod 230 and a control connecting rod 240. A first end of the rocker arm 220 can rotate relative to the main frame 210 when driven by the driving device, and a second end of the rocker arm 220 is pivotally connected to the transmission connecting rod 230. The transmission connecting rod 230 is pivotally connected to the control connecting rod 240. Both ends of the control connecting rod 240 are pivotally connected to the main frame 210 and the footrest extension device 100, respectively.

The main frame 210, the rocker arm 220, the transmission connecting rod 230, the control connecting rod 240 can form a four-bar mechanism. The rocker arm 220 can drive the control connecting rod 240 to move by the transmission connecting rod 230 when driven by the drive device, and the rocker arm 220 is equivalent to an active part of the four-bar mechanism. The control connecting rod 240 can drive the footrest extension device 100 to fold or extend, and the control connecting rod 240 is equivalent to a follower or an actuator of the four-bar mechanism.

The driving device is configured to provide a power required to adjust an activity of the main frame 210 relative to the fixing frame 301 and provide a power required to extend or fold the footrest extension device 100 relative to the main frame 210.

Specially, in an embodiment, the driving device includes a driving component 310, a sliding component 320, a connecting rod for power output 330 and a power output shaft 340. The driving component 310 is fixedly mounted on the fixing frame 301. The fixing frame 301 is provided with a slideway 304 for the sliding component 320 to move. The driving component 310 can drive the sliding component 320 to move along an extension direction of the slideway 304. A first end of the connecting rod for power output 330 is pivotally connected to the sliding component 320 by a first reaming support 321 fixedly mounted on the sliding component 320, and a second end of the connecting rod for power output 330 is pivotally connected to the power output shaft 340 by a second reaming support 322 fixedly mounted on the power output shaft 340. The power output shaft 340 penetrates through the main frame 210, and is fixedly connected to the first end of the rocker arm 220. The sliding component 320 can move relative to the main frame 210 when driven by the driving component 310, resulting in driving the connecting rod for power output 330 to move and driving the power output shaft 340 to rotate around an axis of the power output shaft 340.

In this way, the sliding component 320, the connecting rod for power output 330 and the power output shaft 340 can play a role of decreasing speed and increasing torsion of the output power of the driving component 310, so as to ensure that the rocker arm 220 can receive sufficient driving force to drive the connecting rod component for transmission and the footrest extension device 100.

In order to facilitate a mounting of the second reaming support 322, which is pivotally connected to the connecting rod for power output 330, the power output shaft 340 can also be a power output beam made of angle steel or channel steel. When the driving device is operating, the power output beam can rotate around a bus bar in an extension direction of the power output beam and relative to the main frame 210. Furthermore, the power output beam made of angle steel or channel steel is easier to fixedly connect to the rocker arm 220. For example, in this embodiment, the first end of the rocker arm 220 is provided with a matching hole 221 matching with a cross sectional area of the power output beam, resulting in that the rocker arm 220 and the power output beam have a more stable fixation, and less prone to loose shaking, and it is more convenient for both of the rocker arm 220 and the power output beam to be fastened by a thread connection.

Alternatively, in an embodiment, the driving device can be a motor-belt driving form, and the driving component 310 can be a stepper motor, optionally. The slideway 304 is sheathed with a belt, and the belt is sheathing on a pulley of an output shaft of the stepper motor. The sliding component 320 is fixedly connected with a part of the belt that is located on the slideway 304. When the stepper motor is operating, the stepper motor can drive the pulley to rotate, and the belt can slide along the slideway 304 with the pulley and drive the sliding component 320 to move synchronously with the belt relative to the slideway 304.

In other more embodiments, the driving device can also be a motor-sprocket-chain driving form or a motor-rack-pinion driving form, a movement process of which is similar to that of the motor-belt driving form. Instead of the sliding component 320 and the connecting rod for power output 330, the power output shaft 340 can be directly driven by the driving component 310 to rotate around the axis of the power output shaft 340.

It is understood that the driving device can be in the form of electric control driving or human driving. The driving device can be disposed in multiple groups according to different functional devices or mechanisms. The multiple groups of driving devices can realize an adjustment of a sitting position, a sitting angle and a foot support, respectively. It is understood that the driving device can also be configured to provide power for other more functional devices or mechanisms, and not limited to drive the main frame 210 and the footrest extension device 100.

A conventional existing footrest extension device has poor stability during operation, because a structure of the footrest extension device is complex, a quantity of elements in the footrest extension device is large, and joints between the elements or motion pair elements are not closely matched. The conventional footrest extension device cannot move accurately according to a preset trajectory, and there is a large deviation between a motion trajectory formed during actual operation of the footrest extension device and an ideal preset trajectory. Therefore, an overall structure of the conventional foot extension device is loose, and a wear degree of the joints between the elements will aggravate after long-term use, which is prone to failure and cannot meet requirements of the user well.

In an embodiment of the present disclosure, the footrest extension device 100 includes a first connecting rod 10, a second connecting rod 20, a third connecting rod 30, a fourth connecting rod 40, a fifth connecting rod 50, a sixth connecting rod 60, a seventh connecting rod 70 and an eighth connecting rod 80. The above connecting rods are directly or indirectly pivotally connected by a rotating pivot or a rivet. The footrest extension device 100 is easier to mount and an element or a part required is easier to obtain.

In detail, a first end of the first connecting rod 10 is pivotally connected to the main frame 210, and a second end of the first connecting rod 10 is pivotally connected to the second connecting rod 20 and the third connecting rod 30, respectively. The second connecting rod 20 is pivotally connected to the main frame 210 indirectly by the connecting rod component for transmission, and pivotally connected to the fourth connecting rod 40. The third connecting rod 30 is pivotally connected to the fourth connecting rod 40, the sixth connecting rod 60 and the eighth connecting rod 80, respectively. The fifth connecting rod 50 is pivotally connected to the fourth connecting rod 40 and the sixth connecting rod 60, respectively. The sixth connecting rod 60 is pivotally connected to the seventh connecting rod 70. The seventh connecting rod 70 is pivotally connected to the eighth connecting rod 80.

It should be recognized that the directly pivotal connection mentioned above refers to a common center line or a center point of rotation between two target elements, such as penetrating through two target elements by a rotating pivot, a screw, or a rivet. The indirect pivotal connection mentioned above means that the two target elements are rotationally connected with other intermediate elements, namely, the two target elements are neither directly in contact with nor adjacent to each other.

The main frame 210, the first connecting rod 10, the second connecting rod 20 and the control connecting rod 240 can form a first four-bar mechanism 101. The first connecting rod 10, the second connecting rod 20, the third connecting rod 30 and the fourth connecting rod 40 can form a second four-bar mechanism 102. The third connecting rod 30, the fourth connecting rod 40, the fifth connecting rod 50 and the sixth connecting rod 60 can form a third four-bar mechanism 103. The third connecting rod 30, the sixth connecting rod 60, the seventh connecting rod 70 and the eighth connecting rod 80 can form a fourth four-bar mechanism 104. The four-bar mechanism formed by the main frame 210, the rocker arm 220, the transmission connecting rod 230 and the control connecting rod 240 is a fifth four-bar mechanism 105. The control connecting rod 240 is pivotally connected to the second connecting rod 20, so the footrest extension device 100 and the connecting rod component for transmission together constitute five four-bar mechanisms connected in series.

The driving device can rotate relative to the main frame 210 by the rocker arm 220, driving the fifth four-bar mechanism 105 to move, and then the control connecting rod 240 can drive the second connecting rod 20 to move, resulting in the first connecting rod 10, the third connecting rod 30, the fourth connecting rod 40, the fifth connecting rod 50, the sixth connecting rod 60, the seventh connecting rod 70 and the eighth connecting rod 80 moving. A synchronous movement of the first four-bar mechanism 101, the second four-bar mechanism 102, the third four-bar mechanism 103 and the fourth four-bar mechanism 104 can be realized, resulting in the footrest extension device 100 being folded or extended.

The four-bar mechanisms can produce certain motion trajectories. The footrest extension device 100, the main frame 210 and the connecting rod component for transmission together constitute five four-bar mechanisms connected in series. The driving device can control these five four-bar mechanisms to move only by driving one of these five four-bar mechanisms. Because elements in the four-bar mechanisms are pivotally connected, the motion trajectories of these five four-bar mechanisms are determined. In other words, the motion trajectories of the footrest extension device and the connecting rod component for transmission are kept certain and will not change when the footrest extension device 100 and the connecting rod component for transmission are driven by the driving device multiple times, so as to ensure a consistency of multiple motions of the chair 300.

It is worth noting that the four-bar mechanisms described in the present disclosure shall not be construed as limiting a shape of a polygonal connecting rod mechanism nor a quantity of elements contained in the polygonal connecting rod mechanism. In other words, the connecting rod in a four-bar mechanism refers to a component, not necessarily in individual part. For example, the first connecting rod 10, the second connecting rod 20, the third connecting rod 30, the fourth connecting rod 40, the fifth connecting rod 50, the sixth connecting rod 60, the seventh connecting rod 70, the eighth connecting rod 80, the control connecting rod 240, the transmission connecting rod 230 and the rocker arm 220 are not necessarily individual parts, and one of the connecting rods can also be a connecting rod component with multiple parts fixedly connected as one.

In this embodiment, the driving device can realize movements of the transmission connecting rod 230, the control connecting rod 240 and the footrest extension device 100 by only rotating relative to the main frame 210 by the rocker arm 220, resulting in reducing a quantity of force transmission mechanisms between the driving component 310 and the footrest extension device 100. Each element can almost move simultaneously, and there will be no lag of an element.

It should be noted that a shape of the connecting rods used to form the footrest extension 100 is not limited to be rod-like, but may also be plate or other shapes. In other words, the present disclosure does not make special restrictions on the shapes of the various elements of the footrest extension device 100, and the above naming is only for the convenience of analyzing the movement of the mechanism and should not be interpreted as an explanation of the shapes of the elements pivotally connected to each other directly or indirectly.

Furthermore, in the embodiment, the fourth connecting rod 40 is provided with a first platform 40*a* and the eighth connecting rod 80 is provided with a second platform 80*a*. When the footrest extension device 100 is extended, the first platform 40*a* is flush with the second platform 80*a* in a horizontal direction. When the footrest extension device 100 is folded, the first platform 40*a* is flush with the second platform 80*a* in a vertical direction.

The first platform 40*a* is used as an attaching platform for the rest cushion of the chair 300, and the second platform 80*a* is used as an attaching platform for a stepping cushion in front stool of the chair 300. When the footrest extension device 100 is extended relative to the main frame 210, the attaching platform for the rest cushion is at a position with same height as the attaching platform for the stepping cushion in front stool substantially, which is convenient for the user to lie down completely and put feet flat at the same time. When the footrest extension device 100 is folded relative to the main frame 210, the footrest extension device 100 is fully folded and closed to the main frame 210.

It should be understood that the footrest extension device 100 can also be disposed in two groups. The two groups of the footrest extension device 100 are symmetrically arranged on a longitudinal plane of the fixing frame 301. In other words, when the chair 300 is observed from a side of the chair 300, shapes of the two groups of the footrest extension device 100 coincide with each other. In addition, the main frame 210 and the connecting rod component for transmission are also symmetrically arranged on the longitudinal plane of the fixing frame 301. Both ends of the power output shaft 340 are fixedly connected to two groups of the rocker arms 220 respectively which are symmetrically arranged. When the power output shaft 340 rotates, rotating angles and speeds of the two groups of the rocker arms 220 are same, resulting in driving the two groups of the footrest extension device 100 to move synchronically.

Furthermore, in this embodiment, the fourth connecting rod 40 is located on a side close to the main frame 210 of the eighth connecting rod 80 when the footrest extension device 100 is extended. In other words, the second platform 80*a* is further in front of the user when the user lies down fully.

In this way, an interference between the first platform 40*a* and the second platform 80*a* can be avoided during a change process of the footrest extension device 100 from an extended state to a folded state, namely, motion trajectories of the first platform 40*a* and the second platform 80*a* can be prevented from crossing or even overlapping.

Furthermore, in the embodiment, a first limiting block 11 is disposed on a sidewall of the first connecting rod 10, and the second connecting rod 20 can abut against the first limiting block 11 when the footrest extension device 100 is folded. The first limiting block 11 can prevent the footrest extension device 100 from being excessively folded, reducing collision or even extrusion of multiple connecting rods, thereby avoiding excessive wear of the connecting rods and pivot points between the connecting rods.

In order to prevent the foot extension device 100 from producing a large impact or collision when the foot extension device 100 is folded, the first limiting block 11 can be made of elastic material, which can not only abut against the second connecting rod 20 when the foot extension device 100 is folded, but also reduce an impact on the second connecting rod 20 and other connecting rods, and has an effect of cushioning and damping.

The present disclosure provides the footrest extension device 100. Each element in the footrest extension device is directly or indirectly pivotally connected to form multiple four-bar mechanisms connected in series. A stable and reliable rotating pair is formed between the elements, which overcomes defects of joints between the elements or motion pair elements not being closely matched, and an overall structure of the existing footrest extension device being loose. At the same time, a stability and a response sensitivity of the footrest extension device 100 are improved. Even a mechanism or an element far away from the driving device in the footrest extension device 100 can change a motion state rapidly with the power output of the driving device. Long-term use will not significantly aggravate degree of wear of the joints between the elements, and fault is not easy to produce.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A frame, comprising a main frame, a connecting rod component for transmission and a footrest extension device, wherein the connecting rod component for transmission is pivotally connected to the footrest extension device, and connected to a driving device, the connecting rod component for transmission comprises a rocker arm, a transmission connecting rod and a control connecting rod, the footrest extension device comprises a first connecting rod, a second connecting rod, a third connecting rod, a fourth connecting rod, a fifth connecting rod, a sixth connecting rod, a seventh connecting rod and an eighth connecting rod, the first connecting rod is connected to the main frame, and pivotally connected to the second connecting rod and the third connecting rod, respectively, one end of the second connecting rod is connected to a first end of the control connecting rod, and the other end of the second connecting rod is directly and pivotally connected to the fourth connecting rod, the third connecting rod is directly and pivotally connected to the fourth connecting rod, the sixth connecting rod and the eighth connecting rod, respectively, wherein two ends of the third connecting rod are directly and pivotally connected to the first connecting rod and the eighth connecting rod, respectively, a middle part of the sixth connecting rod is pivotally connected to a middle part of the third connecting rod, the fourth connecting rod is pivotally connected to the middle part of the third connecting rod;

two ends of the fifth connecting rod are directly and pivotally connected to the fourth connecting rod and one end of the sixth connecting rod, respectively;

the other end of the sixth connecting rod is directly and pivotally connected to one end of the seventh connecting rod;

the other end of the seventh connecting rod is pivotally connected to the eighth connecting rod;

the first connecting rod, the second connecting rod, the third connecting rod and the fourth connecting rod form a second four-bar mechanism;

the third connecting rod, the fourth connecting rod, the fifth connecting rod and the sixth connecting rod form a third four-bar mechanism;

the third connecting rod, the sixth connecting rod, the seventh connecting rod and the eighth connecting rod form a fourth four-bar mechanism;

the second connecting rod, driven by the driving device, is able to drive the first connecting rod, the third connecting rod, the fourth connecting rod, the fifth connecting rod, the sixth connecting rod, the seventh connecting rod and the eighth connecting rod to move, resulting in the footrest extension device being folded or extended.

2. The frame of claim 1, wherein a first end of the rocker arm is capable of rotating relative to the main frame driven by the driving device, a second end opposite to the first end of the rocker arm is pivotally connected to the transmission connecting rod, the transmission connecting rod is pivotally connected to the control connecting rod, and a second end of the control connecting rod is pivotally connected to the main frame;

the rocker arm is capable of driving the control connecting rod to move via the transmission connecting rod when driven by the driving device, and the control connecting rod is capable of driving the footrest extension device to fold or extend.

3. The frame of claim 2, wherein the main frame, the first connecting rod, the second connecting rod and the control connecting rod form a first four-bar mechanism;

the main frame, the rocker arm, the transmission connecting rod and the control connecting rod form a fifth four-bar mechanism;

the first four-bar mechanism, the second four-bar mechanism, the third four-bar mechanism and the fourth four-bar mechanism are sequentially far away from the main frame;

the driving device is able to drive the first four-bar mechanism, the second four-bar mechanism, the third four-bar mechanism and the fourth four-bar mechanism to move synchronically by driving the fifth four-bar mechanism.

4. A chair, comprising a driving device, a fixing frame and the frame of claim 2, wherein the driving device and the frame are mounted on the fixing frame.

5. The chair of claim 4, wherein the driving device comprises a driving component, a sliding component, a connecting rod for power output and a power output shaft;

the connecting rod for power output is pivotally connected to the sliding component and the power output shaft, respectively; and the power output shaft is fixedly connected to the first end of the rocker arm;

the sliding component is able to move relative to the main frame when driven by the driving component, resulting in driving the connecting rod for power output to move and driving the power output shaft to rotate around an axis of the power output shaft.

6. The frame of claim 1, wherein the first connecting rod, the second connecting rod, the third connecting rod, the fourth connecting rod, the fifth connecting rod, the sixth connecting rod, the seventh connecting rod and the eighth connecting rod are pivotally connected by a rotating pivot or a rivet.

7. The frame of claim 1, wherein the fourth connecting rod is provided with a first platform and the eighth connecting rod is provided with a second platform;

when the footrest extension device is extended, the first platform is flush with the second platform in a horizontal direction, and when the footrest extension device is folded, the first platform is flush with the second platform in a vertical direction.

8. The frame of claim 1, wherein a first limiting block is disposed on a sidewall of the first connecting rod, and the second connecting rod abuts against the first limiting block when the footrest extension device is folded.

* * * * *